US007458864B2

(12) United States Patent
Philipp

(10) Patent No.: US 7,458,864 B2
(45) Date of Patent: Dec. 2, 2008

(54) ELECTRICAL PLUG CONNECTOR HAVING AN INTERNAL LEAF SPRING

(75) Inventor: Eckhardt Philipp, Schwieberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/711,586

(22) Filed: Feb. 26, 2007

(65) Prior Publication Data

US 2007/0218733 A1 Sep. 20, 2007

(30) Foreign Application Priority Data

Feb. 28, 2006 (DE) ..... 10 2006 009 075

(51) Int. Cl.
*H01R 11/22* (2006.01)

(52) U.S. Cl. ..... 439/851

(58) Field of Classification Search ..... 439/852, 439/851, 839
See application file for complete search history.

(56) References Cited

U.S. PATENT DOCUMENTS

| | | | | |
|---|---|---|---|---|
| 5,226,842 | A * | 7/1993 | Endo et al. | 439/843 |
| 6,024,612 | A * | 2/2000 | Myer et al. | 439/852 |
| 6,062,918 | A * | 5/2000 | Myer et al. | 439/839 |
| 6,290,553 | B1 * | 9/2001 | Sato et al. | 439/843 |
| 6,293,833 | B1 * | 9/2001 | Kamath | 439/851 |
| 2003/0216085 | A1 * | 11/2003 | Maeda | 439/852 |

* cited by examiner

*Primary Examiner*—Phuong K Dinh
(74) *Attorney, Agent, or Firm*—Kenyon & Kenyon LLP

(57) ABSTRACT

In an electrical plug connector which includes an electrically conductive contact element having a plug accommodation provided for the insertion of a contact pin and having a contact lamella that laterally borders on the plug accommodation, as well as a leaf spring fastened to the contact element, which acts upon the contact lamella, the leaf spring is situated between the contact lamella and an outer wall of the contact element.

8 Claims, 3 Drawing Sheets

ELECTRICAL PLUG CONNECTOR HAVING AN INTERNAL LEAF SPRING

BACKGROUND INFORMATION

The difficulty in implementing efficient socket contacts (electrical plug connectors) is, in response to overall space for the plug connections that is getting smaller all the time, to allow to be effective sufficiently great contact normal forces at the contact places between the contact lamellae of the socket contacts and the contact pins (contact blades) of the mating connectors. These contact normal forces are to be designated as being sufficient if they ensure an electrically conductive contact, even in the case of extraneous layers on the metallic surfaces of the contact partners, that is, when such extraneous layers are not pushed through with certainty.

FIG. 2*a* shows a known electrical plug connector (socket contact) 20*a* into which a contact pin is plugged. In this plug contact 20*a*, a current-conducting contact element 21 having a resilient contact lamella 22 is made of a contact material which has a sufficiently great relaxation stability, even at high working temperatures, to counter an inadmissible decrease in the contact normal force over long periods of use. These relaxation-stable and sufficiently conductive contact materials are, however, comparatively expensive.

Apart from that, other electrical plug connectors (socket contact) are known in which, in addition, force support springs (leaf springs), made of materials that are the same or materials that are not the same, assist, by mechanical coupling with the contact lamellae, in achieving the desired contact normal forces at the contact points and in ensuring them in a durable manner. FIG. 2*b* shows a known plug connector 20*b* having a force-supporting spring 23 of the same material, which is made by a material doubling of contact element 21 and acts upon contact lamella 22. FIG. 2*c* shows a known plug connector 20*c* having a leaf spring that is not of the same material (cantilever steel spring) 24, which is formed by a tab set in facing inwards of a steel sleeve 25 that surrounds current-conducting contact element 21, in order to support contact lamella 22 of contact element 21 with respect to the contact normal force. The advantage of such cantilever construction systems is that steel spring materials have a clearly higher relaxation stability, in the working temperature range striven for, than the copper-based alloys used for contact element 21. It is true, though, that one disadvantage of these cantilever construction systems is that the steel sleeve, as a rule, completely surrounds approximately one-half of the contact element, which means a substantial material usage, and with that, high costs.

SUMMARY OF THE INVENTION

Because of the plug connectors according to the present invention, it is possible for the first time, without limiting the technical function of the additional leaf spring, to do without costly steel material of an enclosing steel sleeve, which is only used for fixing and supporting the leaf spring. Beyond that, because of the specific material utilization without having to consider the design of the steel sleeve, constructive freedoms come about for the contour and position of the leaf spring, which are able to be used for an optimization of the spring properties. Using this material-saving force-supporting spring for electrical socket contacts, a uniformly high contact normal force is achieved and maintained of the contact lamella situated below it with respect to the contact pin of the opposite side.

The leaf spring is fitted into the contact element of the plug connector in such a way that only specifically the contact lamella is supported and, because of that, a material-intensive jacketing of the contact element, using a steel sleeve, can be omitted. To do this, preferably the leaf spring is produced, in a material-saving manner, from a narrow steel strip, and during the manufacturing process of the contact element it is positioned on the latter's blank, for instance, mechanically, and fixed. In the subsequent working steps of the stamping and bending process, the blank, along with the fixed leaf spring, is bent to the finished state to form the contact element. Because of the bending sequence, the leaf spring comes to lie behind the contact lamella. In the final arrangement, the contact lamella acquires the task of contacting and conducting current, whereas the narrow leaf spring acts in a force-supporting manner. Because of the nesting of the contact element, the fixing and support of the leaf spring are ensured. In principle, it is also possible to position and fasten the leaf spring only after the complete bending to a finished state of the contact element.

DETAILED DESCRIPTION

Figure 1A:
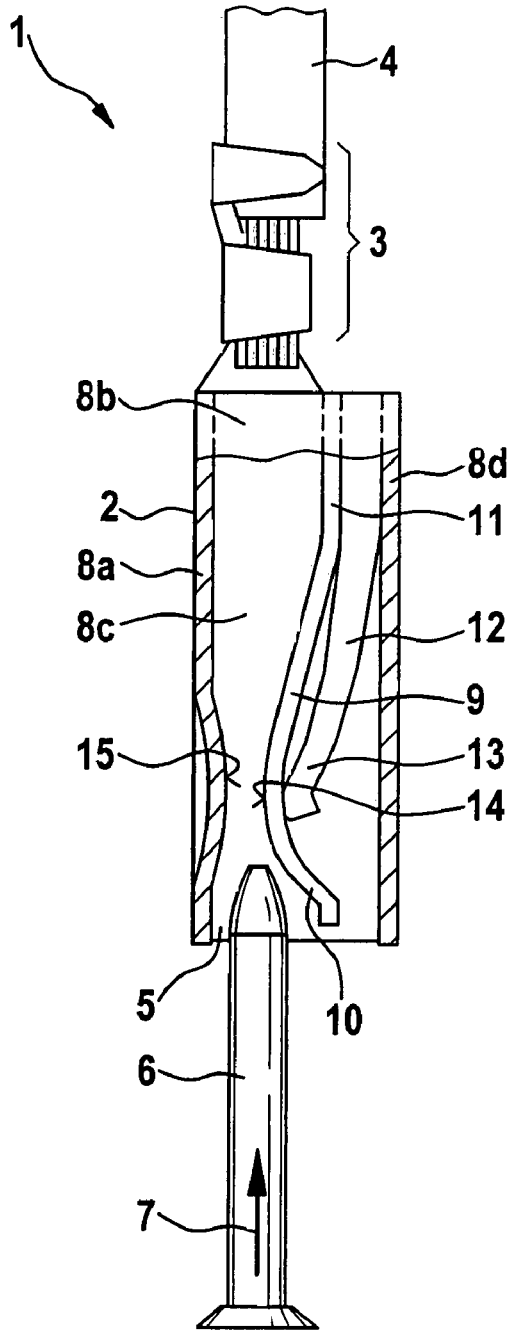
FIGS. 1*a* and 1*b* show the electrical plug connector according to the present invention in the initial state ready for insertion (FIG. 1*a*) and in the plugged-in final state (FIG. 1*b*).

The electrical plug connector 1 shown in FIG. 1*a* includes a contact element 2 which is made of an electrically conductive material, for instance, of a sheet metal (copper), and is produced by stamping and bending. Contact element 2 is connected at one end to a connecting cable 4 through a crimped region 3, and has a plug accommodation 5 at the other end, into which an electrically conductive contact pin (contact blade) 6 is to be inserted in direction of insertion 7.

Plug accommodation 5 is formed laterally by three outer walls 8*a*-8*c* of contact element 2 and a contact lamella 9, whose free end 10 is directed counter to direction of insertion 7 of contact pin 6. The other, fixed end of contact lamella 9 is formed by an intermediate wall 11 of contact element 2, which runs parallel to outer wall 8*d*. Between this outer wall 8*d* and intermediate wall 11 there is situated a leaf spring 12 fastened to contact element 2, whose free end 13 is also directed counter to direction of insertion 7 of contact pin 6, and which acts upon contact lamella 9. Contact lamella 9 has an impressed contact crest 14, and outer wall 8*a* lying opposite contact lamella 9 has a pressed-out contact crest 15.

Leaf spring 12 is a narrow metal strip made of steel, which is, for instance, mechanically positioned and fixed to the sheet metal (contact blank) that is to be reshaped to form contact element 2. In the subsequent working steps of the stamping and bending process, the contact blank, along with fixed leaf spring 12, is bent to the finished state to form the contact element 2. Because of the bending sequence, leaf spring 12 gets to lie behind contact lamella 9, that is, between outer wall 8*d* and intermediate wall 11, and is also clamped between them. In plug connector 1, the contact lamella 9 acquires the task of contacting and conducting current, whereas arrow leaf spring 12 acts in a force-supporting manner. Because of the nesting of contact element 2, the fixing and support of leaf spring 12 are ensured.

Figure 1B:
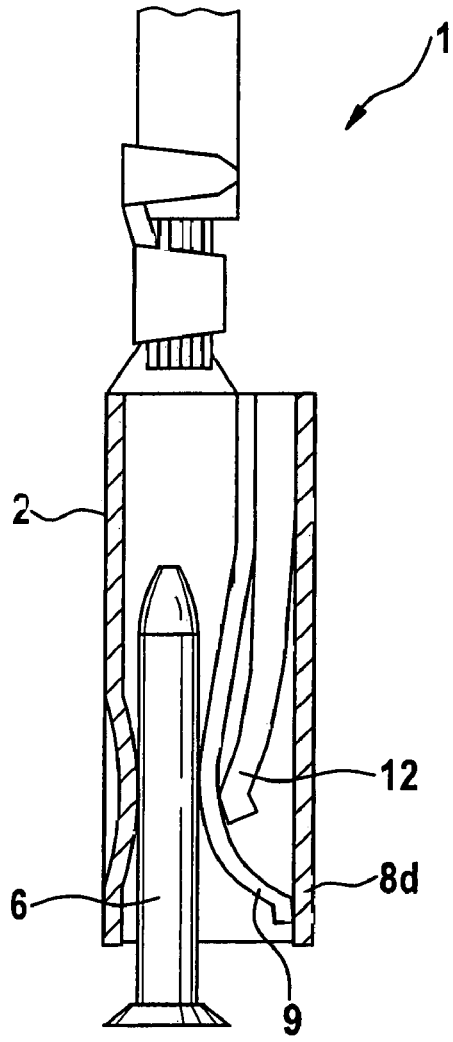
Figure 2A:
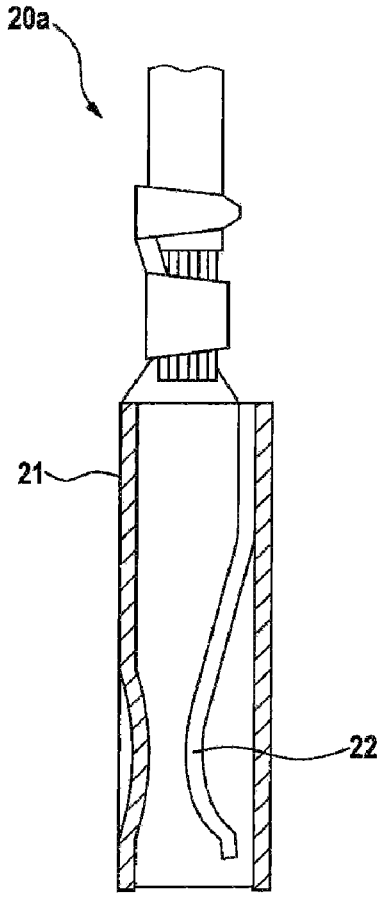
Fig. 2a Prior Art
FIGS. 2*a*-2*c* show various prior known electrical plug connectors not having a leaf spring (FIG. 2*a*), having a leaf spring of the same material (FIG. 2*b*) and having a leaf spring of a different material (FIG. 2*c*).
Figure 2B:
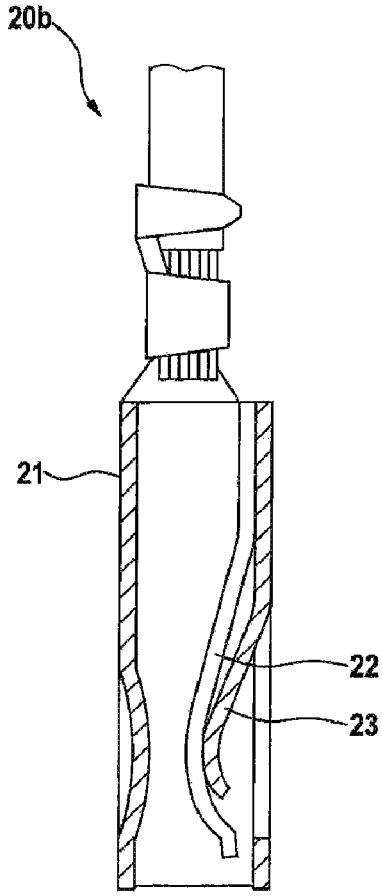
Fig. 2b Prior Art
Figure 2C:
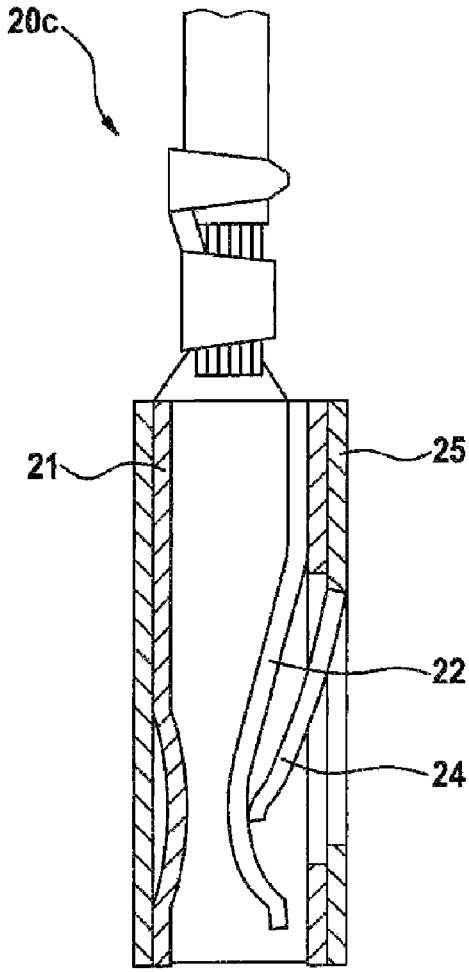
Fig. 2c Prior Art

In the initial state of plug connector 1, that is ready for insertion, shown in FIG. 1*a*, contact lamella 9 is deflected by leaf spring 12 into plug accommodation 5. To form an electrical plug connection, contact pin 6 is pushed into plug accommodation 5 between the two contact crests 14, 15, and, in the process, deflects contact lamella 9 against the action of leaf spring 12, whereby the contact normal force exerted by contact lamella 9 on contact pin 6 is increased. In FIG. 1*b*, electrical plug connector 1 is shown in its ending position and having contact pin 6 completely inserted, by which contact lamella 9 is deflected outwards, against the action of leaf spring 12, until it lies against outer wall 8*d* of contact element 2.

What is claimed is:

1. An electrical plug connector comprising:

an electrically conductive contact element having a plug accommodation provided for an insertion of a contact pin and having a contact lamella that laterally borders on the plug accommodation; and a leaf spring being fastened to the contact element between the contact lamella and an outer wall of the contact element, acting upon the contact lamella, and being situated between the contact lamella and the outer wall of the contact element, wherein the leaf spring is a strip of material separate from the contact element; and wherein the contact lamella is able to be deflected outwards up to making contact with the outer wall of the contact element.

2. The electrical plug connector according to claim 1, wherein the leaf spring is a metal strip.

3. The electrical plus connector according to claim 2, wherein the metal strip is made of steel.

4. The electrical plug connector according to claim 1, wherein the contact lamella is deflected by the leaf spring into the plug accommodation in an initial state of the plug connector.

5. The electrical plug connector according to claim 1, wherein a free end of at least one of the contact lamella and the leaf spring is directed counter to an insertion direction of the contact pin.

6. The electrical plug connector according to claim 1, wherein the contact element is formed by stamping and bending of a sheet metal.

7. The electrical plug connector according to claim 1, wherein the contact lamella has an impressed contact crest for an electrical contacting of the inserted contact pin.

8. The electrical plug connector according to claim 1, wherein a wall of the contact element, which borders on the plug accommodation while lying opposite to the contact lamella, has a pressed-out contact crest for an electrical contacting of the inserted contact pin.

* * * * *